United States Patent [19]

Postlethwaite

[11] 4,119,557

[45] Oct. 10, 1978

[54] BLEACHING COMPOSITIONS AND PROCESS FOR CLEANING FABRICS

[75] Inventor: Dennis Postlethwaite, Birkenhead, England

[73] Assignee: Lever Brothers Company, New York, N.Y.

[21] Appl. No.: 750,787

[22] Filed: Dec. 15, 1976

[30] Foreign Application Priority Data

Dec. 18, 1975 [GB] United Kingdom ..... 51859/75

[51] Int. Cl.[2] ..... C11D 3/33; C11D 3/395; C11D/7/56 D06L 3/02

[52] U.S. Cl. ..... 252/99; 8/111; 252/95; 252/102; 252/110; 252/133; 252/186; 252/527; 252/DIG. 11

[58] Field of Search ..... 252/95, 99, 102, 527, 252/DIG. 11, 186, 110, 133; 8/109, 111

[56] References Cited

U.S. PATENT DOCUMENTS

| | | | |
|---|---|---|---|
| 3,156,654 | 11/1964 | Konecny | 252/95 |
| 3,488,288 | 1/1970 | Hill | 252/99 |
| 3,532,634 | 10/1970 | Woods | 252/95 |
| 4,028,281 | 6/1977 | Millard | 252/527 |

*Primary Examiner*—Dennis L. Albrecht

[57] ABSTRACT

Bleaching compositions comprising a hydrogen peroxide liberating persalt, such as sodiumperborate, and a preformed ferric ion complex with a polycarboxyamine-type chelating agent, selected from the group consisting of ethylene diamine tetraacetic acid, nitrilotriacetic acid, diethylene triamine pentaacetic acid, and hydroxyethyl ethylene diamine triacetic acid, and mixtures thereof. The composition is used for cleaning fabrics.

6 Claims, No Drawings

BLEACHING COMPOSITIONS AND PROCESS FOR CLEANING FABRICS

This invention relates to bleaching compositions and a process for cleaning fabrics.

Fabric washing compositions comprising at least one surface-active compound of the anionic, nonionic or zwitterionic type and a percompound bleaching agent, such as sodium perborate, sodium persilicate, sodium percarbonate and sodium perphosphate, are known. The amount of percompound bleaching agent used in such compositions is normally about 5–35% by weight of the total composition.

It is known that many heavy metal ions catalyse the decomposition of $H_2O_2$ and $H_2O_2$-producing percompounds, such as sodium perborate. It has also been suggested, to use heavy metal salts together with a chelating agent, for improving the bleaching activity of percompound bleaches.

Not all heavy metals nor all chelating agents on combination appeared to be suitable for improving the bleaching performance of $H_2O_2$-producing percompound bleaches. Many combinations indeed show no effect or even a worsening effect on the bleaching performance; no proper rule seems, however, to exist by which the effect of metal ion/chelating agent combinations on the bleaching performance of percompound bleaches can be predicted.

Many attempts have been made to select the most suitable metal/chelating agent combination for said purpose and to correlate bleach-catalysing effect with some physical constants of the combination, so far without much success. U.S. Pat. No. 3,156,654 suggested particularly cobalt and copper salts in conjunction with pyridine-2-carboxylic acid or pyridine-2,6-dicarboxylic acid, preferably as a preformed complex as being a suitable combination. Further British Pat. Nos. 984,459 and 1,192,524 suggested the use of a copper salt in combination with other specific chelating agents, such as methylaminodiacetic acid, aminotriacetic acid, hydroxyethylaminodiacetic acid, ethylene diamine tetraacetic acid, and diethylene triamine pentaacetic acid.

Typical is that previous investigators have focussed their efforts practically towards the use of non-ferrous metals such as Cobalt and Copper salts. This is probably understandable from the fact, that all these metals including Cobalt and Copper-ions are known as very powerful $H_2O_2$-decomposition catalysts.

It has now been found that, quite surprisingly, certain pre-formed ferric ion chelate complexes have a pronounced activating effect, which is at least equal to or even much better than many of the hitherto known specific metal ion/chelating agent combinations on the bleaching performance of hydrogen peroxide and persalts, which effect, unlike that of some other metal ion/-chelate systems, is reproducible and consistent.

The effect is quite surprising since not much attention has hitherto been paid to iron as a heavy metal catalyst for bleaching, possibly due to opined inferiority to other metals. The effect is furthermore surprising since the effect observed is specific to ferric ion in combination with specific chelating agents.

The term "persalt" is used here to mean a salt which releases hydrogen peroxide in aqueous solution, such as e.g. the alkali metal perborates, percarbonates, persilicates and perphosphates.

Accordingly the invention provides a bleaching composition for fabrics incorporating therein a persalt and a pre-formed ferric ion chelate complex.

The invention also provides a process for cleaning fabrics by contact with an aqueous solution of hydrogen peroxide or a persalt and a pre-formed ferric ion chelate complex.

The pre-formed ferric ion chelate complex used in the present invention is formed with a particular group of polycarboxyamine type chelating agents. The polycarboxyamine type chelating agents used in conjunction with the ferric ion according to the invention are ethylenediaminetetraacetate (EDTA), hitrilotriacetate (NTA), diethylene triamine pentaacetic acid (DTPA) and hydroxyethyl ethylene diamine triacetic acid (HEEDTA). For practical reasons a complex of ferric ion with ethylenediaminetetraacetic acid is preferred, particularly the one comprising ethylene diamine tetraacetic acid ferric mono sodium salt.

The complex of the invention can be readily prepared by the simple addition of a water-soluble ferric salt, e.g. ferric sulphate, to a warm to hot solution of the chelating agent, from which the complex is isolated either by precipitation or crystallisation or by any other known separation technique.

The above-mentioned EDTA-ferric mono sodium salt can be prepared by the addition of a water-soluble ferric salt, e.g. ferric sulphate, to a hot solution of EDTA (tetra- or disodium salt). The pale yellow complex crystallises out of solution and is a stable non-hygroscopic solid, which on analyses appears to have the general formula $[Fe.EDTA.nH_2O]^-.Na^+$ in which $n = 0–2$. It has a stability constant of 25.1 at 25° C.

As the persalt bleaching agent which is used in the present invention can be mentioned e.g. sodium perborate tetrahydrate, the best known and most used percompound, as well as other persalts known in the art, such as sodium perborate monohydrate, sodium percarbonate, sodium persilicate and sodium perphospates.

The range within which the ferric ion chelate complex in solution shows enhancement of the bleaching performance of hydrogen peroxide and persalts begins already at levels as low as 1 ppm and extends further to above 70 ppm. On observation of a curve plotted for a 15 minute isothermal wash at 90° C., the main characteristics thereof are a rapid and pronounced bleach activation on introduction of the complex of the invention into the system, followed by a gradual decline of the activation performance on further increase of the complex level over the concentration range studied. The optimum pH for the best bleaching with the ferric ion chelate complex is between 9 and 10, preferably between 9.2–9.8.

A major advantage of the present invention is that iron is used here, which unlike other heavy metals, such as copper, chromium, nickel and cobalt, is quite a harmless and non-sensitising metal, making the invention attractive for use in all sorts of applications where there is possible skin contact.

The practical value of the present invention is that at the same persalt level in the product an increased bleaching action is achieved, and consequently a certain bleaching level can be achieved by using a lower proportion of the persalt in the composition at the expense of adding only very minor proportions of the complex of the invention.

According to the invention the optimum feasible concentration range for the ferric ion chelate complex in the wash-solution is of the order of 2.5–50 ppm, preferably 5–40 ppm, or expressed in more desirable molar terms, from about 5–135 μmoles/liter, preferably 10–120 μmoles/liter.

Based on the normal dosage of use of 5 g/liter of bleaching, or bleaching and detergent compositions, said range will correspond to about 0.05%–1.0% by weight, preferably from about 0.1% to about 0.8% by weight of the total composition. In admixture with a persalt bleaching agent the ferric ion chelate complex will be present in an amount of about 0.1–7%, preferably 0.25–5%, by weight of the persalt.

Thus the invention pertains to a bleaching, or a bleaching and detergent composition incorporating therein essentially from 0% to about 50% by weight of an organic surface-active agent selected from the group consisting of anionic, nonionic, zwitterionic, cationic detergents, and mixtures thereof; from about 5% to about 80% by weight of builder salts; from about 5% to about 35% by weight of a persalt bleaching agent; and from about 0.05% to about 1.0% by weight of a pre-formed ferric ion chelate complex.

Preferred are detergent and bleaching compositions which contain from about 5% to about 35% by weight of an organic surface-active agent selected from the group consisting of anionic and nonionic detergents, and mixtures thereof; from about 10% to about 60% by weight of water-soluble builder salts, preferably comprising sodium tripolyphosphate; from about 10% to about 25% by weight of a persalt bleaching agent, preferably selected from the group consisting of alkali metal perborates, alkali metal percarbonates, and mixtures thereof; and from about 0.1% to about 0.8% by weight of a pre-formed ferric ion chelate complex.

The pH of the composition of the invention (measured from a 0.5% solution) should preferably lie within the range of about 8.5–10.5, more preferably between 9–10.

In addition thereto, inert salts, such as sodium sulphate, and any of the conventional adjuncts used in bleaching and detergent compositions, such as fluorescent agents, soil suspending agents, e.g. sodium carboxymethyl cellulose; alkaline agents, corrosion inhibitors, and other auxiliary agents including enzymes may be present in the composition of the invention.

Typical anionic detergents are the alkylbenzene sulphonates having from 8–16 carbon atoms in the alkyl group, e.g. sodium dodecylbenzene sulphonate; the olefin sulphonates having from 10–20 carbon atoms, obtained by reacting an alpha olefin with gaseous diluted sulphur trioxide and hydrolysing the resulting product; alkyl sulphates such as tallow alcohol sulphate; and alkali metal salts of long chain fatty acids, such as stearic acid and/or palmitic acid.

Typical water-soluble nonionic detergents are the condensation products of alkyl phenols with ethylene oxide e.g. the reaction product of nonylphenol with 6–30 ethylene oxide units; condensation products of higher fatty alcohols, such as tridecyl alcohol and secondary $C_{10}$–$C_{15}$ alcohols with ethylene oxide, known under the trade name of "Tergitols"® supplied by Union Carbide; condensation products of tallow alcohol with ethylene oxide; condensation products of fatty amide with 8–15 ethylene oxide units and the condensation products of polypropylene glycol with ethylene oxide. Zwitterionic detergents include derivatives of aliphatic quaternary ammonium, phosphonium and sulphonium compounds in which the aliphatic moieties can be straight chain or branched, and wherein one of the aliphatic substituents contains from 8 to 18 carbon atoms and one contains an anionic water-solubilizing group.

Cationic detergents include the quaternary ammonium compounds, e.g. cetyl trimethyl ammonium bromide or chloride; and the fatty alkyl amines.

It is an important feature of the present invention that the ferric ion chelate complex is preformed before it is incorporated in the bleaching, or bleaching and detergent composition, or before addition to the bleaching bath, since only then there will be a maximum benefit achievable.

The compositions of the invention may be presented in any of the known solid forms of bleaching or bleaching and detergent compositions, e.g. as a powder, which term includes also hollow beads such as obtained from spray-drying a slurry, coarse particles, and fine powders; as flakes, as granulates and as tablets.

A preferred form of the composition is a powder which is obtained by the conventional spray-drying technique, wherein the basic detergent ingredients including the pre-formed ferric ion chelate complex is formed into a slurry which is then fed to a spray-drying tower to form a dry free-flowing powder which is collected at the bottom of the tower. Any heat-sensitive ingredients can be dry mixed with the spray-dried powder. Alternatively the pre-formed ferric ion chelate complex may be incorporated by post-addition as a separate ingredient to the spray-dried base powder.

As explained above, the composition of the invention on dissolving in water will produce effective concentrations of the ferric ion chelate complex in the bleaching bath to catalyse the bleaching action of the persalt e.g. sodium perborate, to a satisfactory extent.

Accordingly in a further aspect, the invention pertains to a process for cleaning fabrics by contacting said fabrics with an aqueous solution of hydrogen peroxide or a persalt, which solution contains from about 1–70 ppm, preferably from 2.5–50 ppm, of a pre-formed ferric ion chelate complex.

In one more specific embodiment of the invention the process comprises the use of a solution comprising a persalt and 2.5–50 ppm of a ferric ion chelate complex selected from the group of $Fe^{3+}$/EDTA, $Fe^{3+}$/NTA, $Fe^{3+}$/DTPA, $Fe^{3+}$/HEEDTA and mixtures thereof, and having a pH of about 8.5–10.5. A preferable range of complex level is 5–40 ppm; a preferable pH range is from about 9–10.

It should be appreciated as indicated before that the invention is applicable with any of the known percompound bleaching agents, including hydrogen peroxide and percompounds which liberate hydrogen peroxide in aqueous solution, such as the alkali metal perborates, percarbonates, persilicates, perphosphates, etc.

The invention can be applied to bleaching and cleaning baths such as are used for treating textiles, to wash liquors such as are used in commercial and domestic launderings, and to solid bleaching compositions.

In practising the invention the man in the art is of course free to choose any level of the pre-formed complex within the range as defined hereinbefore, as he would think desirable for serving his purpose, but for economic reasons in the majority of cases the lowest level that still brings about the highest activation will be selected for use.

The advantages of the invention are shown in the following illustrative examples:

EXAMPLE I

The effect of various $Fe^{3+}$ systems on perborate bleaching using two detergent bases was investigated.

Bleach tests were conducted in clean systems on tea-stained cotton test pieces using deionised water.

The results for given additives are shown in Table I in which bleaching scores are expressed in terms of conventional reflectance increase values ($\Delta R_{460}$).

Bleach/washing conditions 15 min. isothermal wash at 90° C.

0.375% detergent base solution + 0.125% sodium perborate.

$Fe^{3+}$ level = 1 ppm (= 6.5 ppm pre-formed $Fe^{3+\lambda}$/EDTA complex, when present).

EDTA level = 0.1% and 0.2% (when added separately).

TABLE I

| Additive | Detergent Base A ΔR | Detergent Base B ΔR |
|---|---|---|
| None | 14.8 | 13.1 |
| $Fe^{3+}$ + EDTA | 15.9 | 16.8 |
| $Fe^{3+}$ + 2 EDTA | 14.4 | — |
| $Fe^{3+}$/ EDTA complex | 17.6 | 20.1 |

| Compositions of detergent bases | A | B |
|---|---|---|
| Sodium dodecylbenzene sulphonate | 20.6 | 30.6 |
| Coconut ethanolamide | 3.9 | 4.6 |
| Sodium toluene sulphonate | 2.6 | — |
| Sodium tripolyphosphate | 45.2 | 53.6 |
| Alkaline silicate | 14.2 | — |
| Sodium sulphate | 13.7 | 9.2 |
| Sodium carboxymethylcellulose | — | 1.5 |

The results show that there is a definite advantage in the use of the pre-formed $Fe^{3+}$/EDTA complex over the $Fe^{3+}$ and EDTA added separately.

EXAMPLE II

This example illustrates the effect of $Fe^{3+}$/EDTA complex level on the bleaching performance of sodium perborate.

Bleach tests were conducted in clean systems on tea-stained cotton test pieces using deionised water.

The results are shown in Table II, in which bleaching scores are expressed in terms as used in Example I.

Bleach/washing conditions 15 min isothermal wash at 90° C.; heat-up from 20°-95° C.

0.375% detergent base solution + 0.125% sodium perborate.

TABLE II

| Complex level ppm in wt % in soln. product | | Detergent Base A Heat-up 20-95° C ΔR | Detergent Base B 15 min isothermal wash at 90° C ΔR |
|---|---|---|---|
| 0 | 0 | 16.6 | 16.1 |
| 1.3 | 0.03 | — | 18.1 |
| 2.6 | 0.05 | — | 19.6 |
| 3.9 | 0.08 | — | 19.7 |
| 5.2 | 0.10 | — | 19.7 |
| 6.5 | 0.13 | 22.0 | 20.7 |
| 13.1 | 0.26 | 21.0 | 21.0 |
| 19.5 | 0.40 | 20.6 | 20.1 |
| 26.0 | 0.52 | 20.6 | 19.4 |
| 32.5 | 0.65 | 20.1 | 19.3 |

EXAMPLE III

This example illustrates the effect of $Fe^{3+}$/NTA complex, $Cu^{2+}$/EDTA complex and $Co^{2+}$/EDTA complex on the bleaching performance of sodium perborate.

Bleach tests were conducted in clean systems on tea-stained cotton test pieces using deionised water.

Bleach/washing conditions 0.375% detergent base A + 0.125% sodium perborate 15 min isothermal washes at 75° C. and 90° C.

The results are shown in Table III.

TABLE III

| Complex | Level ppm in soln. | 75° C ΔR | 90° C ΔR |
|---|---|---|---|
| $Fe^{3+}$/NTA | 0 | 6.9 | 13.9 |
| | 4.4 | 7.9 | 15.8 |
| | 8.7 | 9.1 | 17.0 |
| | 21.8 | 9.6 | 15.1 |
| | 43.6 | 8.2 | 12.3 |
| $Cu^{2+}$/EDTA | 0 | — | 14.5 |
| | 6.2 | — | 13.5 |
| | 12.4 | — | 11.6 |
| | 31.1 | — | 13.3 |
| | 62.2 | — | 15.0 |
| $Co^{2+}$/EDTA | 0 | 7.7 | 14.7 |
| | 6.7 | 7.8 | 14.4 |
| | 13.3 | 8.5 | 14.4 |
| | 33.3 | 8.1 | 11.5 |
| | 66.6 | 8.6 | 10.7 |

note:
4.4 ppm $Fe^{3+}$/NTA≡6.2 ppm $Cu^{2+}$/EDTA≡6.7 ppm $Co^{2+}$/EDTA = 1 ppm metal ion equivalent.

These results clearly show the non-effectiveness of copper/EDTA and cobalt/EDTA complexes to catalyse bleaching by sodium perborate, in contrast to the positive effects observed with a ferric ion chelate complex of the invention.

EXAMPLE IV

This Example illustrates the effect of $Fe^{3+}$/EDTA complex on commercial products containing sodium perborate.

Three commercial perborated detergent powders were obtained, UK Surf, UK biological OMO and UK Tide, and their perborate levels were determined by iodometric titration. The following perborate levels were found:

UK Surf — 22.3%

UK Biological OMO — 22.8%

UK Tide — 18.8%

Bleach tests (heat-up wash cycle 20°-95° C.) conducted with these powders at 0.5% product concentration and at different $Fe^{3+}$/EDTA levels on tea-stained cotton test cloths using deionised water gave results as shown in Table IV below.

TABLE IV

| Complex level ppm soln. | UK Surf ΔR | Bio OMO ΔR | Tide ΔR |
|---|---|---|---|
| 0 | 19.9 | 17.8 | 15.6 |

| Complex level ppm soln. | UK Surf ΔR | Bio OMO ΔR | Tide ΔR |
|---|---|---|---|
| 6.5 | 24.5 | 22.3 | 19.4 |
| 13.1 | 22.5 | 21.7 | 18.6 |
| 19.5 | 22.8 | 21.1 | 19.0 |
| 26.0 | 21.8 | 20.5 | 18.2 |

-continued

| Complex level ppm soln. | UK Surf ΔR | Bio OMO ΔR | Tide ΔR |
|---|---|---|---|
| 32.8 | 21.4 | 20.7 | 18.3 |

The results again demonstrate a pronounced activating effect for systems concerning $Fe^{3+}$/EDTA complex of the invention.

EXAMPLE V

In order to assess perborate savings which may be realised with $Fe^{3+}$/EDTA catalysed bleaching, experiments were performed at different perborate levels. Two series of experiments were conducted. The first series of experiments directly compared the effect of a constant level of $Fe^{3+}$/EDTA complex at decreasing perborate levels with the performance of perborate alone.

First series of experiments 15 min. isothermal washes at 90° C.

0.375% detergent base A + sodium perborate 6.5 ppm $Fe^{3+}$/EDTA complex (≡ 1 ppm $Fe^{3+}$ on solution ≡ 0.13% complex on base powder)

The results are given in the following Table V1

TABLE V1

| Perborate level % on product | $\Delta_R$ |
|---|---|
| 13 | 11.7 |
| 16 | 12.7 |
| 19 | 14.2 |
| 22 | 15.5 |
| 25 | 16.4 |
| 25* | 15.1 |

*Control experiment without complex.

These results when plotted graphically will show that the 25% perborate product without complex is equivalent to one containing about 21% perborate + 0.13% ferric ion/EDTA complex. This suggests that use of the complex may save approximately 4% of sodium perborate.

A second series of experiments was conducted, comparing a system outside the invention with the system of the invention using the following bleach/washing conditions:

15 min. isothermal washes at 90° C. using deionised water.

0.375% detergent base A $Fe^{3+}$ = 1 ppm EDTA = 5.5 ppm.

$Fe^{3+}$/EDTA complex = 6.5 ppm

The results are given in the following Table V2 below.

TABLE V2

| Additive | Perborate levels 10% $\Delta_R$ | 15% ΔR | 20% ΔR | 25% $\Delta_R$ |
|---|---|---|---|---|
| None | 9.2 | 10.2 | 12.5 | 15.0 |
| $Fe^{3+}$+EDTA | 8.4 | 10.1 | 13.5 | 15.9 |
| $Fe^{3+}$/EDTA complex | 9.4 | 11.8 | 15.2 | 17.6 |

These results again confirm the superiority of the preformed $Fe^{3+}$/EDTA complex over its separate components.

Graphical treatment of the data shows that a product containing 19.5% perborate + 0.13% complex is equivalent to a 25% perborate only product, giving a potential perborate saving in this instance of approximately 5.5%.

EXAMPLE VI

The following Example gives a further illustration of the effectiveness of ferric ion complexes according to the invention for activating the bleach performance of $H_2O_2$ at 90° C. Figures are also given for some cobalt and copper complexes, for comparison.

Bleach tests were conducted using an isothermal wash at 90° C. for 15 minutes, as the standard conditions. The complexes assessed were prepared by simple aqueous mixing in stoichiometric ratio of metal ion and chelating agent, followed by isolation, either by precipitation or crystallisation.

All evaluations were conducted in solutions of an EDTA-free detergent base A of Example I and a standard complex level such that its level of metal ion in solution was 1 ppm, was adopted.

To 250 ml of base solution (0.375%), thermostatted at 90° C., were added 1.0 ml of standard metal ion complex solution, four tea-stained test pieces (5 × 5 cm), and finally sodium perborate (0.313 g) in that order. After 15 minutes the test pieces were withdrawn and subsequently, after rinsing and drying, assessed reflectometrically at R 460. Control runs were conducted in the absence of metal ion complex.

The results are summarised in the following Table VI.

TABLE VI

| Complex | Bleach increment[1] Δ(ΔR) | Activation Ratio[2] A.R. | Complex Equivalent Level[3] C.E.L. (%) |
|---|---|---|---|
| $Fe^{3+}$/NTA | + 2.9 | 1.19 | 21 |
| $Fe^{3+}$/DTPA | + 2.4 | 1.16 | 22 |
| $Fe^{3+}$/HEEDTA | + 2.3 | 1.15 | 22 |
| $Fe^{3+}$/EDTA | +2.7 | 1.14 | 22 |
| $Cu^{2+}$/NTA | + 2.8 | 1.15 | 22 |
| $Cu^{2+}$/DTPA | − 0.3 | 0.98 | 26 |
| $Cu^{2+}$/EDTA | − 1.0 | 0.93 | 27 |
| $Co^{2+}$/EDTA | − 0.3 | 0.98 | 26 |
| $Co^{2+}$/DPA[4] | − 0.5 | 0.92 | 27 |
| $Co^{2+}$/PA[5] | −10.0 | 0.47 | 53 |

[1]Bleach increment Δ(ΔR): The reflectance difference between clothes bleached in the presence and absence of complex, i.e. $\Delta(\Delta R) = \Delta R_c - \Delta R_p$ where $\Delta R_c$ = Reflectance increase from perborate + complex $\Delta R_p$ = Reflectance increase from perborate alone.

[2]Activation ratio (A.R.): The ratio of reflectance increase in the presence of complex to that in its absence, i.e. A.R. = $\Delta R_c / \Delta R_p$

[3]Complex equivalent level (C.E.L.): Level of perborate required in a system with the complex for its performance to match that of 25% perborate alone; i.e. C.E.L. = 25/A.R.

[4]Pyridine-2,6-dicarboxylic acid.

[5]Pyridine-2-carboxylic acid.

The above results show that under the conditions tested all the $Fe^{3+}$ complexes examined increased the bleach performance; the $Cu^{2+}$ complexes and $Co^{2+}$ complexes tested generally deactivated bleach performance, except for $Cu^{2+}$/NTA. Apparently they act principally as efficacious $H_2O_2$ decomposition catalysts.

I claim:

1. A bleaching and detergent composition for cleaning fabrics comprising from 5% to 50% by weight of an organic surface-active agent selected from the group consisting of anionic, nonanionic, zwitterionic and cationic detergents, and mixtures thereof; from 5% to 80% by weight of builder salts; from 5% to 35% by weight of a persalt selected from the group consisting of alkali metal perborates, alkali metal percarbonates and mixtures thereof; and from 0.05% to 1.0% by weight of a preformed ferric ion chelate complex, said complex being a complex of ferric ion with ethylene diamine tetraacetic acid, nitrilotriacetic acid, diethylene triamine pentaacetic acid, or hydroxyethyl ethylene diamine triacetic acid.

2. A composition according to claim 1, comprising from 5% to 35% by weight of an organic surface-active agent selected from the group consisting of anionic and nonionic detergents, and mixtures thereof; from 10% to 60% by weight of sodium tripolyphosphate; from 10% to 25% by weight of said persalt, and from 0.1% to 0.8% by weight of said preformed ferric ion chelate complex.

3. A composition according to claim 1, having a pH, measured from a 0.5% solution of 8.5–10.5.

4. A composition according to claim 3, wherein the pH is from 9–10.

5. A composition according to claim 1, wherein said ferric ion chelate complex is present in an amount of about 0.1–7.0% by weight of the persalt.

6. A composition according to claim 5, wherein said complex is present in an amount of 0.25–5% by weight of the persalt.

* * * * *